United States Patent [19]

Box

[11] Patent Number: 4,490,096

[45] Date of Patent: Dec. 25, 1984

[54] PUMP SYSTEM FOR LIQUID/SOLID MATERIALS WITH BALANCED OUTPUT

[75] Inventor: Frederick J. Box, St. Albans, England

[73] Assignee: Hands-England Drilling Limited, Hertfordshire, England

[21] Appl. No.: 522,376

[22] PCT Filed: Nov. 25, 1982

[86] PCT No.: PCT/GB82/00335

§ 371 Date: Jul. 22, 1983

§ 102(e) Date: Jul. 22, 1983

[87] PCT Pub. No.: WO83/01983

PCT Pub. Date: Jun. 9, 1983

[30] Foreign Application Priority Data

Nov. 25, 1982 [GB] United Kingdom ..... 8135494

[51] Int. Cl.[3] ..... F04B 9/10; F04B 15/02

[52] U.S. Cl. ..... 417/342; 417/344; 417/346

[58] Field of Search ..... 417/342, 344, 346

[56] References Cited

U.S. PATENT DOCUMENTS 3,481,622 9/1976 Hall et al. ..... 417/344 X 3,847,511 11/1974 Cole ..... 417/342

FOREIGN PATENT DOCUMENTS 1360800 7/1974 United Kingdom .

1389486 4/1975 United Kingdom .

*Primary Examiner*—Richard E. Gluck

*Attorney, Agent, or Firm*—Seidel, Gonda & Goldhammer

[57] ABSTRACT

A pump system, particularly suitable for pumping wet mixes and slurries, achieves an output of pumped material substantially free from pulsations or fluctuations by control movement of power pistons (12A,12B) within power cylinders (10A, 10B). The power pistons (12A,12B) are connected by piston rods (14A,14B) to pumping pistons (16A,16B) which suck material to be pumped in through valves (20A,20B) and out through valves (22A,22B) into a delivery pipe (26). A closed loop (32) connects annular chambers (13A,13B) of the power cylinders (10A,10B), and a continuously operating pump (P2) feeds the closed loop (32). The power pistons (12A,12B) on their suction strokes move faster than on the delivery strokes, whereby one or other or both pistons (12A,12B) are always moving forwards. Control adequate to achieve a smooth delivery of pumped material is achieved by providing sensing valves (PVA1,PVA2, PVB1,PVB2) on each power cylinder (10A,10B), these valves being arranged to be actuated at different positions of the power piston (12A,12B) within the cylinder. The sensing valves pass signals to check valves (CV1,CV2) to vent and close the closed loop (32) in response to actuation of the sensing valves and thus to control movement of the power pistons in the cylinders.

19 Claims, 5 Drawing Figures

PUMP SYSTEM FOR LIQUID/SOLID MATERIALS WITH BALANCED OUTPUT

This invention relates to pump systems, and is particularly concerned with pump systems which are appropriate for propelling wet mixes and slurrys along a pipe, or even for the pumping of water. For example, the pump system of the present invention may be used for propelling a wet mix of concrete, or for the transportation of solids such as coal, limestone and the like which can be made into a slurry. The pump system of the present invention may also be used to pump "mud", the so-called mixture used in the drilling of wells, bored foundations, etc. The pump system can also be used as a pressure intensifier, for example for forcing a grout into rock or other porous material. The pump system of the present invention can also be used in conjunction with machines which produce continuous plastics extrusions, the pump system being used to force granular plastics material into the machine. The pump of the present invention can be adapted for use at very high pressures.

The pump system of the present invention is based upon a system which comprises at least two cylinders, in each of which a pump piston (or in the limit case the free end of a piston rod) is reciprocated by hydraulic or other power, with valve arrangements being provided so that, as each pump piston is moved backwards, i.e. is retracted, it draws the liquid, slurry, mix or the like into its associated cylinder from a suitable source, and as each pump piston moves forward it forces the liquid, slurry, mix or the like out of the cylinder and along a delivery pipe or the equivalent.

A disadvantage of known pump systems of this general type is that the rate of delivery of the material fluctuates, in that as one pump piston ends its forward movement the column of mix in the delivery pipe tends to come to a halt, and then, as the next pump piston commences a forward movement, it has to accelerate the whole column of mix in the delivery pipe. This leads to undesirable mechanical stresses in the system and to a waste of power, due primarily to the fact that the column of mix has to be accelerated twice in every pumping cycle.

British patent specification GB No. 1581640 describes a pumping system in which there are two cylinders each divided into two chambers by an interior wall. A piston rod extends through each wall and carries a piston at each end. The annular chamber in one cylinder between the dividing wall and one of the pistons is hydraulically connected to the corresponding annular chamber in the other cylinder between its dividing wall and the corresponding piston. A small pump feeds the connecting line and this line is equipped with a relief valve. The interconnection and the small pump effect a return movement of the pistons, whereby the return stroke of each piston is completed more rapidly than the forward stroke, and the forward stroke of each piston begins before the other piston completes its forward stroke.

However, this known system is not able to overcome the problem of preventing fluctuations in the output of material delivered. In this known system there would be sudden increases in pressure in the connecting line at certain times in the pump cycle, and this would cause pressure and flow variations in the output of the pumped material.

It is an object of the present invention to provide an improved pump system which reduces such fluctuations to a minimum and which is thus substantially free from mechanical and hydraulic shock. This is achieved by ensuring not only that the column of material in the delivery pipe does not stop between every single pump piston stroke, but also that there is an appropriate transfer of power from one piston to the other to result in a smooth, non-fluctuating output.

It is a further object of the invention to provide the pump system with a control circuit which senses given instants in the pumping cycle and responds thereto to cause a balanced output to be maintained.

Because the energy required to accelerate the material in the delivery pipe may be a relatively large part of the input power, this means that by using the pump system of the present invention the ratio of power consumed to useful work done will be much improved. Additionally, with the pump system of the present invention, a higher degree of reliability should be achieved as compared with conventional systems. The elimination of peak pressures also makes the pipelines and all the joints more reliable in use. As a consequence, it is possible to work at a higher mean pressure, thus making possible a proportionately higher rate of flow for a given expenditure of energy. This means that the pump system of the present invention is not only more reliable and troublefree in use, but that it can operate more efficiently and economically.

In accordance with the present invention there is provided a pump system comprising at least two pumping cylinders in each of which a displacement member is reciprocably movable, an equal number of power cylinders in each of which a power piston is reciprocably movable, piston rods connecting the respective pistons and displacement members, first valve means associated with said pumping cylinders and arranged so that as each displacement member moves in one direction material to be pumped is drawn into the asociated pumping cylinder from a source and as each displacement member moves in the other direction it forces the indrawn material into delivery means, pipe means connecting the annular chambers of each of the power cylinders between the power piston and the end of the cylinder through which the piston rod passes, said pipe means forming part of a closed loop circuit which is connected to a source of pressurised fluid, and control means governing the flow of the pressurised fluid in said closed loop circuit such that the power pistons and displacement members are retracted faster than they move forwards and such that before any one displacement member finishes its forward movement the other or another displacement member commences its forward movement whereby a smooth delivery of pumped material is obtained, wherein said control means comprises sensing valve means associated with each power cylinder and arranged to be actuated at at least two positions of the power piston within the power cylinder, and check valve means connected to vent and close the closed loop circuit and responsive to the actuation of said sensing valve means.

Preferably, the control means is such that the output of material pumped is substantially free from pulsations or fluctuations in output velocity. With the present invention this is achieved even with conventional pump piston and cylinder units, two or more in number.

In one preferred embodiment of pump system in accordance with the invention, two displacement members are used, each directly connected to a respective hydraulic power cylinder. The source of fluid pressure is a power-driven pump with a smooth or relatively smooth output flow. An arrangement of valves causes the two displacement members to reciprocate alternately. The hydraulic system has the ability to drive the two displacement members, i.e. pump pistons, forward each at such a speed that the sum of the two forward velocities is always equal to the maximum forward velocity of either piston. In other words, the speed of the return stroke of each pump piston is always faster than the speed of its forward stroke. By this means, the succeeding forward stroke of the one pump piston can start before the prevailing forward stroke of the other pump piston is completed. This is because the whole of the main hydraulic power pump output is fed into one or other or both of the two power cylinders and none of the pump output escapes during the changeover period. Thus, when the first pump piston is decelerating, the second pump piston is accelerating, with each pump piston moving at such a rate that the total pump system output is always equal to the full speed output of either pump cylinder.

In a preferred embodiment the sensing valve means for each power cylinder comprises a first valve which is actuated when the power piston reaches substantially the end of its retraction stroke and a second valve which is actuated when the power piston is at a position a predetermined distance before the end of its forward stroke.

Preferably, each of said sensing valve means is connected directly to said source of pressurised fluid and upon actuation in the sense to open the valve means allows the fluid pressure generated by said source to pass to said check valve means to open said check valve means and vent the closed loop circuit.

Preferably, the system includes a power-driven pump to supply fluid under pressure for displacement of said power pistons, a directional valve connected between said power-driven pump and the power cylinders, and means connecting the output side of said sensing valve means to said directional valve whereby pressure from said power-driven pump is switched progressively from one power cylinder to another in dependence on movement of the power pistons in the power cylinders.

In order that the invention may be fully understood, preferred embodiments of pump system in accordance with the invention will now be described by way of example and with reference to the accompanying drawings, in which.

Figure 4:
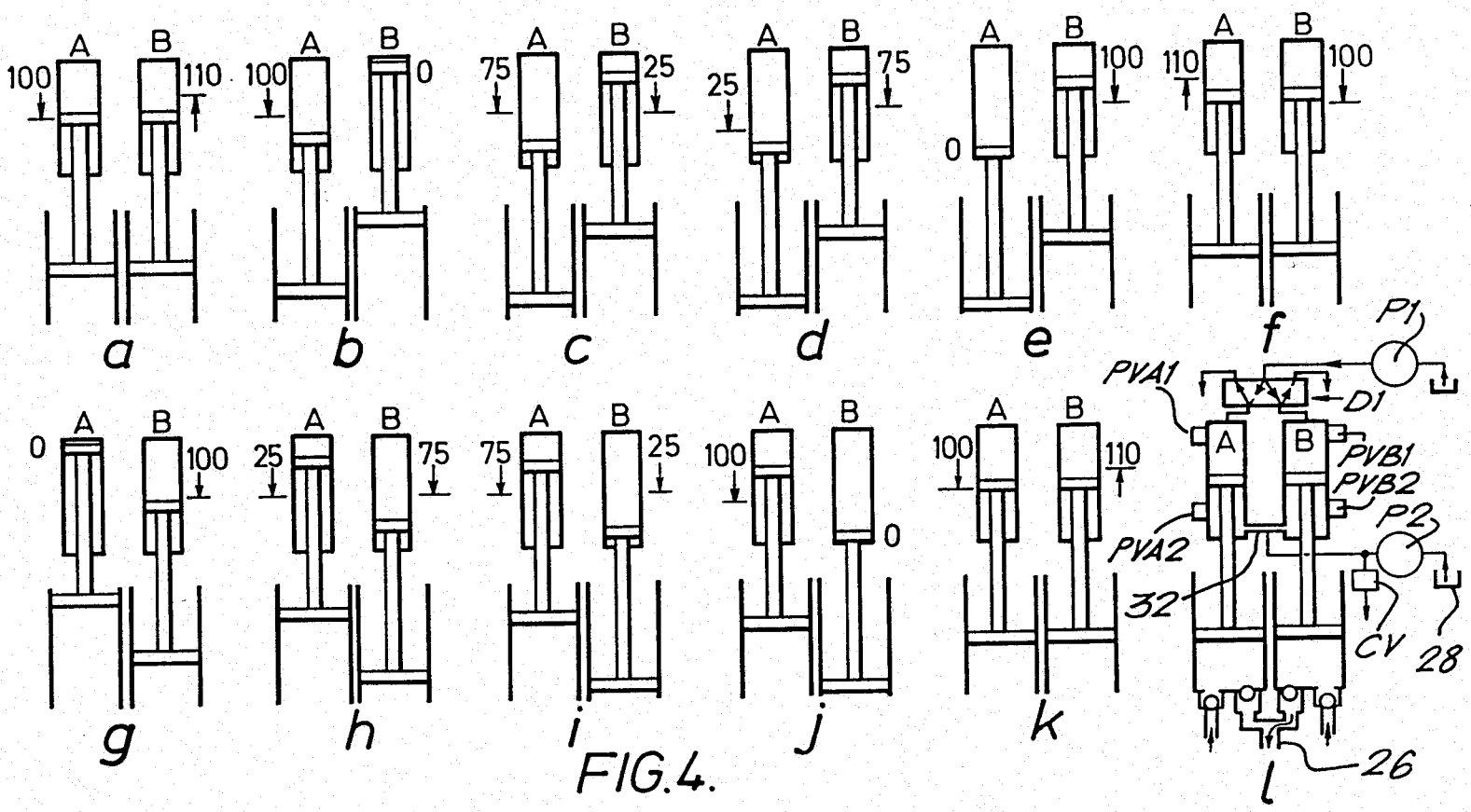
Figure 5:
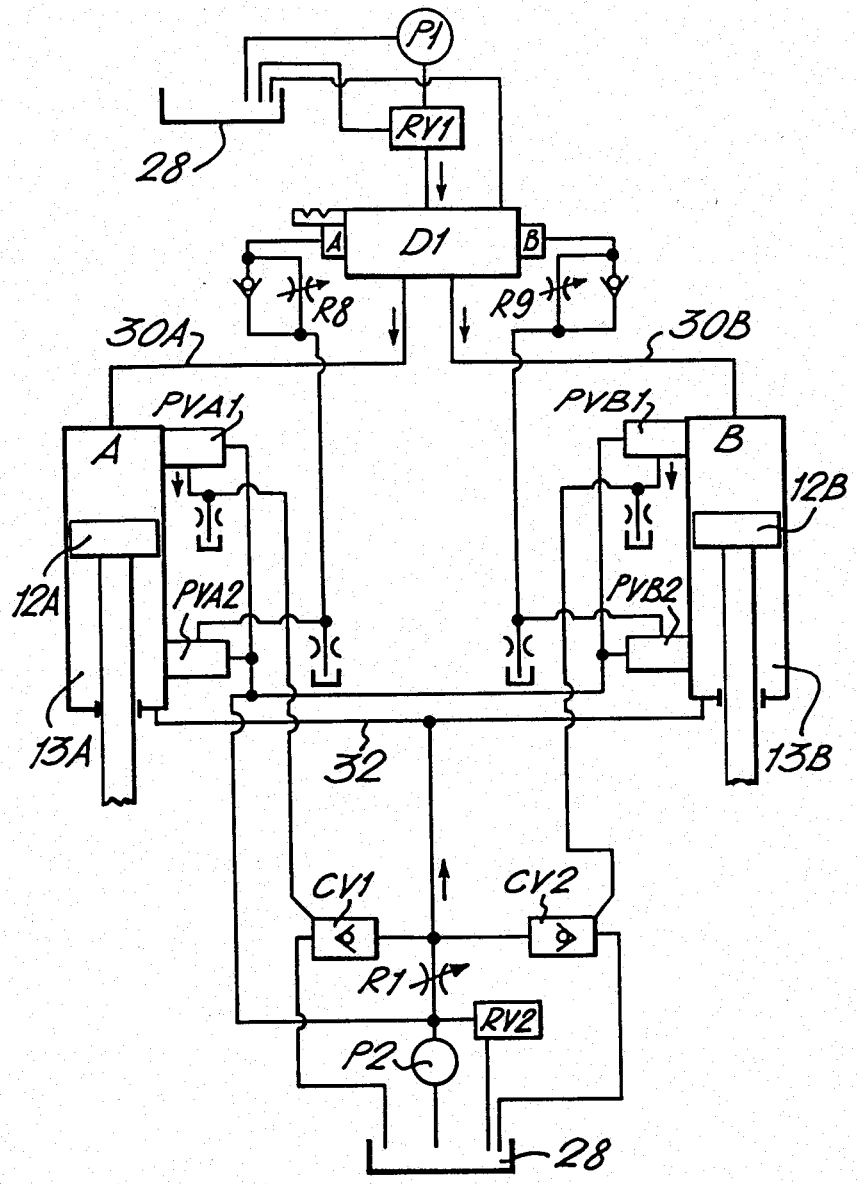

FIGS. 4*a*–4*l* is a sequence diagram illustrating the piston movements in one operating cycle; and, FIG. 5 is a schematic diagram of a second, simplified embodiment of pump system in accordance with the invention.

The pump systems shown in the drawings consist of just two pump piston and cylinder units functioning as displacement members for the material to be pumped. It should be clearly understood however that the invention is not limited to such an arrangement, and that more than two such units can be used if appropriately coupled together for jointly controlled operation.

In the drawings the two pump piston and cylinder units are indicated generally as A and B, for ease of reference.

Figure 1:
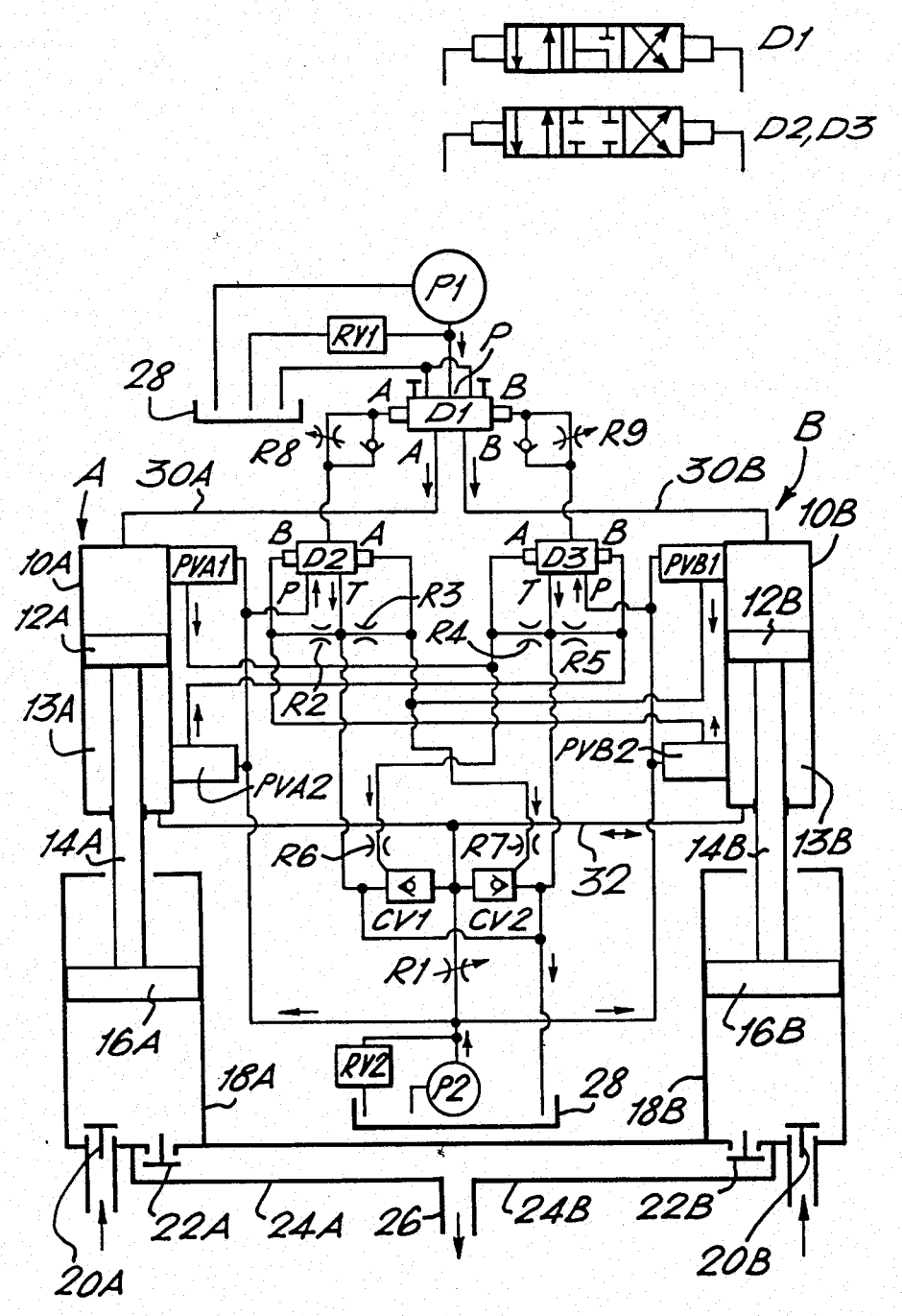
FIG. 1 is a schematic diagram of a first embodiment of pump system in accordance with the invention.

Referring first to FIG. 1, unit A comprises a power cylinder 10A within which a power piston 12A is displaceable. The power piston 12A is connected by a piston rod 14A to a pumping piston 16A which is displaceable within a pumping cylinder 18A. The pumping cylinder 18A is equipped with a pair of aspirating valves 20A and 22A in the end of the cylinder. The material to be pumped is drawn in through valve 20A and is expelled through valve 22A to one branch 24A of a delivery pipe 26 through which the pumped material passes. The valves 20A and 22A may be positively operated valves, or alternatively may be naturally aspirated valves.

In a similar manner, the unit B comprises a power cylinder 10B, a power piston 12B, a piston rod 14B, a pumping piston 16B, a pumping cylinder 18B, inlet and outlet valves 20B and 22B respectively, and a branch pipe 24B leading to the main delivery pipe 26.

The system comprises a power-driven hydraulic pump P1 which supplies fluid under pressure to a directional valve D1. The output side of the pump P1 also has a connection through a relief valve RV1 to a tank 28. The hydraulic pump P1 has its inlet line also in communication with the tank 28. The directional valve D1 is a two-position, pilot-operated, free spool valve, and a schematic representation of it is included in FIG. 1. The directional valve D1 has output lines 30A and 30B to the respective power cylinders 10A and 10B.

The annular volumes 13A, 13B of the power cylinders 10A and 10B between the power pistons and the lower or head end of the cylinders are connected to each other by a pipe 32 which can be regarded as a "closed loop". In other words, when the power piston 12A is extending, i.e. moving down in FIG. 1, the oil displaced from the annular volume 13A of power cylinder 10A is forced through the closed loop 32 to cause the piston 12B of power cylinder 10B to retract, i.e. move up in FIG. 1, and vice versa.

A hydraulic control system pump P2 supplies hydraulic fluid at a precise rate of flow, via a pressure-compensated flow control valve R1, to the closed loop 32. The control pump P2 also provides pressurised fluid to a pair of mechanically operated pilot valves associated with each power cylinder 10A, 10B. These pilot valves are located at or adjacent to each end of each power cylinder. Valves PVA1 and PVA2 are provided for power cylinder 10A and valves PVB1 and PVB2 are provided for power cylinder 10B. These pilot valves are poppet valves arranged to be closed by springs and opened mechanically as the associated piston reaches predetermined positions within the cylinder. These valves will be described in more detail later with reference to FIGS. 2 and 3. All the four pilot valves are supplied from the control pressure circuit which incorporates a relief valve RV2 which stabilises the pressure. Surplus fluid is returned to tank 28.

The outputs of pilot valves PVA1 and PVA2 are connected to the pilot ports (indicated as A and B) of a directional valve D3. Pilot valves PVB1 and PVB2 are similarly connected to a directional valve D2. The directional valves D2 and D3 are two-position, pilot operated, detent-located valves which respond instantly to the pressure signals received and remain located by the detent. Each valve D2, D3 has an inlet port P connected to the output side of control pump P2 and a port T connected to the control system tank 28. Adjustable restrictors R2, R3, R4 and R5, which may be removable jets, are provided associated with the respective directional valves D2 and D3. These are necessary because the pilot-operated valves D2, D3 have no exhaust ports, so that, when the valves D2 and D3 move, the exhausting fluid displaced by the moving pilot piston is able to escape.

Finally, the control circuit includes two pilot-operated check valves CV1 and CV2. Each check valve has a control port connected to pilot valves PVA1 and PVB1 respectively. When pressurised, these check valves CV1, CV2 open and allow fluid in the closed loop to escape back to tank 28. Check valve CV1 has its pilot-control piston connected to pilot valve PVA1 so that as the piston 12A arrives at the end of the retraction stroke and opens PVA1, a pressure control signal, via restrictor R6, opens check valve CV1 and allows fluid in the closed loop to escape to tank. Pilot valve PVB1 and check valve CV2 act in the same way, via restrictor R7. Further adjustable restrictors R8 and R9 are provided in the connecting lines between the directional valves D2 and D3 and the directional valve D1 respectively.

Figure 2:
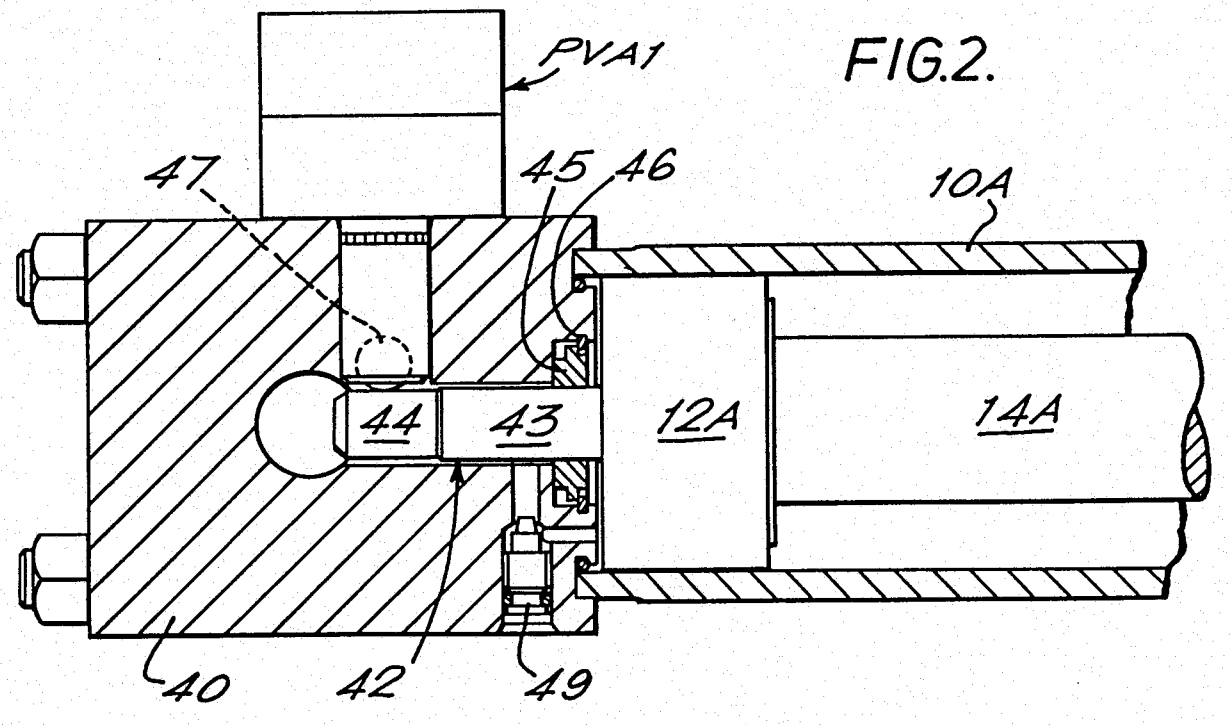
FIG. 2 is a part-sectional view of the upper, or cap, end of one of the power cylinders of FIG. 1.
Figure 3:
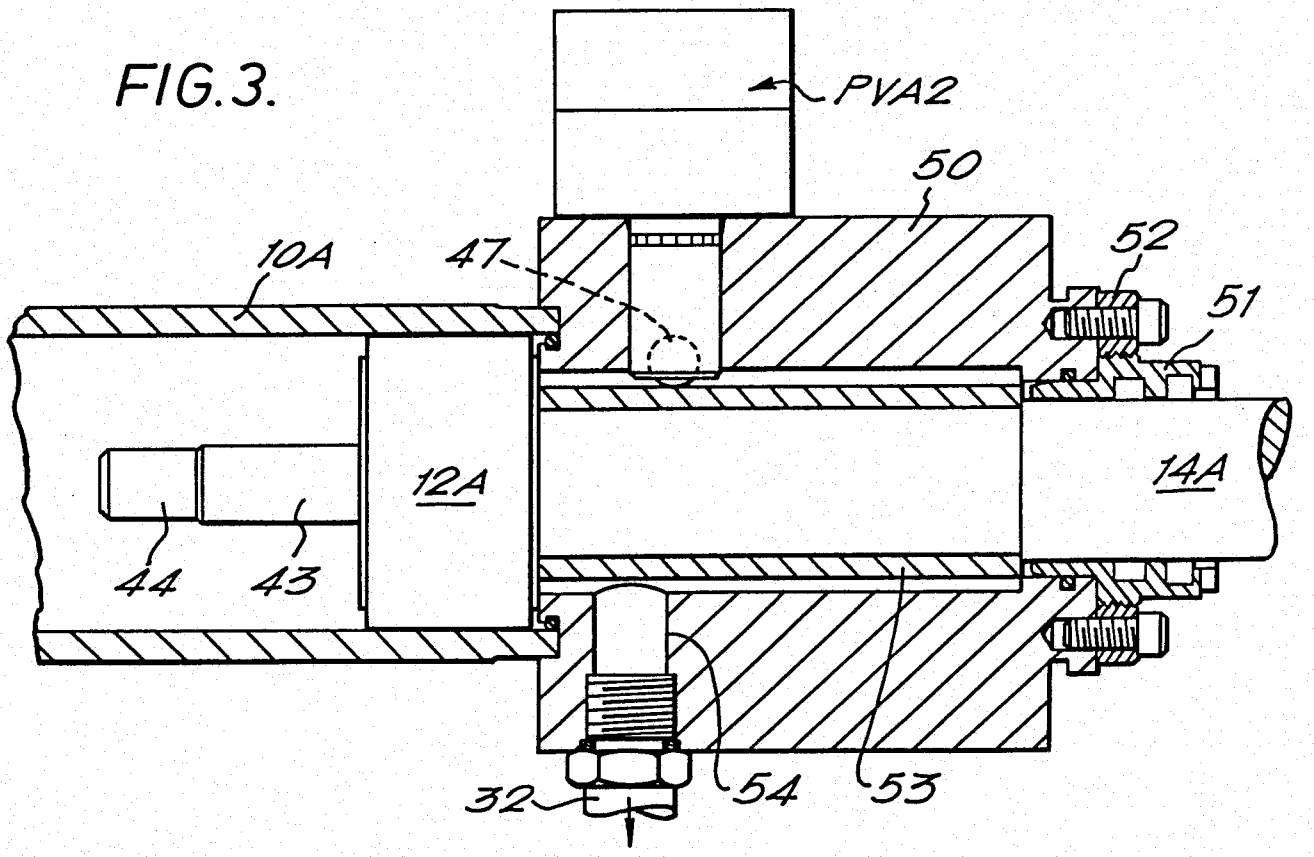
FIG. 3 is a part-sectional view of the lower, or head, end of the same power cylinder.

FIGS. 2 and 3 show in more detail how the pilot valves PVA1, PVA2, PVB1 and PVB2 are mounted on the cylinders and how they are actuated by the moving pistons 12A and 12B. The reference numbers used in FIGS. 2 and 3 correspond with those of the pump piston and cylinder unit A. The upper end of cylinder 10A as shown in FIG. 1 is the cap end and is shown in FIG. 2 A manifold block 40 is fitted to the end of the cylinder 10A. Outwardly of the piston 12A there is provided an extension rod 42 which has a first portion 43 of a first diameter and a second portion 44 of a lesser diameter. The extension rod 42 is a sliding fit in a bore in the block 40. Around the opening of the bore is provided a floating cushion bush 45 which is held in place by a retaining ring 46 and through which the extension rod plunges. The smaller diameter portion 44 of the extension rod is arranged to engage and displace a ball 47 of the pilot valve PVA1 when the extension rod slides home at the end of the retraction stroke. The ball 47 projects proud of the end surface of the body of the valve and is in contact with a needle roller which itself acts axially on a poppet which is subjected to an axial load by a spring. Displacement of the ball 47 by the extension rod causes the poppet to lift from its seat, compressing the spring, and allowing passage of the pressurised fluid from the control pump P2 through the valve. A hydraulic cushion adjusting screw is indicated at 49.

FIG. 3 shows the other end of the cylinder 10A where the pilot valve PVA2 is mounted on a head end block 50. The structure of valve PVA2 is identical to that of valve PVA1. The block 50 is sealed off by a piston rod gland 51 held by a retainer 52 which is bolted to the block. The portion of the piston rod 14A next to the piston 12A is equipped with a valve actuating sleeve 53 which engages and depresses the ball 47 of the pilot valve. However, because of the length of the sleeve 53 and the position of the pilot valve PVA2 the pilot valve is actuated by the sleeve some time before the piston 12A reaches the end of its stroke and engages the head end block 50. The head end block 50 incorporates an output bore 54 which connects with a pipe constituting one end of the closed loop 32.

The method of operation of the pump system of FIG. 1 will now be described. The hydraulic pump P1 supplies pressurised fluid by way of the directional valve D1 to the power pistons 12A, 12B to produce the extension strokes. As mentioned above, the annular volumes 13A and 13B of the two power cylinders 10A and 10B are connected by the closed loop pipe 32. The control pump P2 provides a supplementary pressure, supplying a precise rate of flow of fluid by way of the control valve R1 to the closed loop. This causes the retracting power piston 12A or 12B to travel faster than would otherwise be the case, and it thus completes its stroke sooner than the other, extending power piston. At the completion of the retraction stroke of each power piston 12A, 12B, the built-in hydraulic cushion within the power cylinder, formed by the cap manifold 40 and the extension rod 42 (FIG. 2), arrests the motion of the piston. At the beginning of the cushioned period, taking unit B as an example, the pilot valve PVB1 is mechanically operated, i.e. opened, allowing pilot pressure to go to A of directional valve D2 and to the control port of the pilot-operated check valve CV2. This allows pilot pressure to go via directional valve D2 to A of directional valve D1, via the check valve of restrictor R8. Directional valve D1 cannot respond at this time because pilot pressure is already in pilot port B of the valve. When check valve CV2 is thus opened by the application of pilot pressure, the closed loop 32 is vented to the tank 28, allowing power piston 12A to continue moving forwards. Power piston 12A, at a point about 10% before the actual end of its forward stroke, as determined by the length of the valve actuating sleeve 53 (FIG. 3), opens pilot valve PVA2. This allows pilot pressure to go to port B of directional valve D3. This connects pilot port B of directional valve D1 to the tank 28, thus allowing directional valve D1 to respond to the pilot pressure which is already present at its port A.

Thus, pressure from the main pump P1, via the directional valve D1, is switched progressively from power cylinder 10A to power cylinder 10B, the speed being dependent upon the setting of the adjustable restrictor R9. Power piston 12A progressively slows and stops; at the same time power piston 12B starts to move and progressively accelerates to full speed. As the extension rod 42 moves away from the pilot valve PVB1 and releases the valve ball so the pilot valve PVB1 closes, causing closure of check valve CV2 and sealing the closed loop, thus causing power piston 12A to begin its retraction stroke. This completes one half of the cycle.

As mentioned above, the four pilot valves associated with the power cylinders are mechanically operated to open and are closed by springs. As they are two-port, seated valves, no exhaust port is provided. The four removable jets or adjustable restrictors R2, R3, R4 and R5 provide a permanent leak path back to tank 28, thus allowing the check valves CV1 and CV2 to be closed by springs as soon as the pilot pressure is cut off. The adjustable restrictors or removable jets R6, R7, R8 and R9 are provided to control the speed of reaction of the respective valves. The relief valve RVl associated with the main pump P1 controls the maximum working pressure. The relief valve RV2 associated with the control pump P2 controls the pilot pressure.

FIG. 4 is a diagrammatic representation of the aforesaid sequence of events on the pumping cycle. This pumping system has as a principal characteristic the fact that the piston on the suction stroke moves faster than the piston on the delivery stroke, which allows it to start the next delivery stroke before the prevailing delivery stroke is completed. Thus, for a short time, both pistons are moving forward at the same time, and there is therefore no cessation of movement; that is, one or other or both pistons are always moving forward. The retraction stroke is achieved by piping the oil from the underside of one piston to the underside of the other. The increase of speed is gained by the delivery of pump P2 being continuously fed into the pipe connecting the two cylinders. This oil is released as and when necessary by the check valve CV (equivalent to CV1 and CV2). The figure by the side of each cylinder is the speed shown as a percentage of full speed, figures greater than 100% representing movement supplemented by the pump P2.

(a) Piston A is moving at 100% of full speed and piston B is moving at about 110% of full speed.

(b) Piston B is stopped by the hydraulic cushion and actuates valve PVB1 which causes check valve CV to open.

(c) Piston A actuates valve PVA2 which causes valve D1 to switch the oil output of pump P1 progressively from piston A to piston B; when piston B starts to move valve PVB1 causes valve CV to close.

(d) D1 continues to switch over. Piston A slows down and piston B accelerates.

(e) D1 completes its movement. Piston A stops; piston B accelerates to 100% speed.

(f) Piston A accelerates to 110%

(g) Piston A stops; valve PVA1 opens check valve CV.

The second half of the cycle, i.e. stages H to L, is a mirror image of the first half of the cycle. The output is exactly in proportion to the input of pressure oil from pump P1.

The 10% boost indicated as provided by pump P2 is only a typical figure; a greater or lesser figure can be selected as desired to achieve a smooth, non-fluctuating output.

FIG. 5 shows a modified pump system. Components which are the same as or equivalent to components in FIG. 1 are indicated by the same references. For simplicity, only part of the complete pump system is shown, the pumping pistons and output circuit being omitted, but being equivalent to what is shown in FIG. 1. The main distinguishing feature of the FIG. 5 system is that the two directional valves D2 and D3 have been omitted. This can be achieved by using a modified main valve D1 which has two detents so that it will remain located by the detents, and by modifying the connections of the control circuit. The outputs of pilot valves PVA1 and PVB1 now go directly to the respective control ports of the check valves CV1 and CV2. The outputs of pilot valves PVA2 and PVB2 now go to the tank 28, as do lines from the rectrictors R8 and R9 associated with the two ends of the main valve D1.

The operation of this system is as follows. If piston 12A is on its retraction stroke, then at the end of its stroke the pilot valve PVA1 will be actuated, and this opens check valve CV1 to relieve pressure from the closed loop 32. Piston 12B continues to move down. When piston 12B actuates pilot valve PVB2, a signal is passed to the B end of main valve D1, which then switches the pressure from cylinder B to cylinder A. As soon as piston 12A releases pilot valve PVA1, venting of the closed loop ceases, and piston 12B starts its retraction stroke. This completes half the cycle. When piston 12B actuates pilot valve PVB1 the closed loop is vented again, etc.

Although in the illustrated embodiments the pumping pistons 16A, 16B are larger in surface area than the power pistons 12A, 12B, the reverse condition is also possible, with relatively large cross-section power pistons and small cross-section pumping pistons. In the limit case the pumping piston can be reduced to just the free end of the piston rod, in which case a seal is provided around the entry of the piston rod into the pumping cylinder. Very high pumping pressures can be generated in this way.

As referred to above, the pump system of the present invention is capable of widespread application to the pumping of all manner of materials. Due to its smooth continuity of output flow, the pump system is particularly appropriate for the feeding of a wet mix to a concrete spray gun, thus giving better control of the water content.

I claim:

1. A pump system comprising at least two pumping cylinders in each of which a displacement member is reciprocably movable, an equal number of power cylinders in each of which a power piston is reciprocably movable, piston rods connecting the respective power pistons and displacement members, first valve means associated with said pumping cylinders and arranged so that as each displacement member moves in one direction material to be pumped is drawn into the associated pumping cylinder from a source and as each displacement member moves in the other direction it forces the indrawn material into delivery means, pipe means connecting the annular chambers of each of the power cylinders between the power piston and the end of the cylinder through which the piston rod passes, said pipe means forming part of a closed loop circuit which is connected to a source of pressurised fluid, and control means governing the flow of the pressurised fluid in said closed loop circuit such that the power pistons and displacement members are retracted faster than they move forwards and such that before any one displacement member finishes its forward movement the other or another displacement member commences its forward movement whereby a smooth delivery of pumped material is obtained, wherein said control means comprises sensing valve means associated with each power cylinder and arranged to be actuated at at least two positions of the power piston within the power cylinder, and check valve means connected to vent and close the closed loop circuit and responsive to the actuation of said sensing valve means.

2. A pump system as claimed in claim 1, in which the sensing valve means for each power cylinder comprises a first valve which is actuated when the power piston reaches substantially the end of its retraction stroke and a second valve which is actuated when the power piston is at a position a predetermined distance before the end of its forward stroke.

3. A pump system as claimed in claim 2, in which said predetermined distance is of the order of 10% of the length of the stroke of the power piston.

4. A pump system as claimed in claim 1, in which said sensing valve means comprise mechanically operated pilot valves.

5. A pump system in accordance with claim 2 in which each of said sensing valves is connected directly to said source of pressurized fluid and, when opened, allows the fluid pressure generator by said source to pass to an associated valve of said check valve means to open said associated valve and vent the closed loop circuit.

6. A pump system as claimed in claim 1, which includes a power-driven pump to supply fluid under pressure for displacement of said power pistons, a directional valve connected between said power-driven pump and the power cylinders, and means connecting the output side of said sensing valve means to said directional valve whereby pressure from said power-driven pump is switched progressively from one power cylinder to another in dependence on movement of the power pistons in the power cylinders.

7. A pump system as claimed in claim 6, which includes a further pilot-operated directional valve between the output side of the sensing valve means of each power-cylinder and said directional valve connected to the power-driven pump.

8. A pump system as claimed in claim 6, in which adjustable flow restrictors are provided in association with each directional valve.

9. A pump system as claimed in claim 1, which includes adjustable flow restrictors associated with said check valve means to control the speed of reaction thereof.

10. A pump system as claimed in claim 1, in which the retraction movement of the power piston in each power cylinder is stopped by a hydraulic cushion.

11. A pump system as claimed in claim 7, in which adjustable flow restrictors are provided in association with each directional valve.

12. A pump system comprising at least two pumping cylinders in each of which a displacement member is reciprocably moveable, an equal number of power cylinders in each of which a power piston is reciprocably movable, piston rods connecting the respective power pistons and displacement members, first valve means associated with said pumping cylinders and arranged so that as each displacement member moves in one direction material to be pumped is drawn into the associated pumping cylinder from a source and as each displacement member moves in the other direction it forces the indrawn material into delivery means, pipe means connecting the annular chambers of each of the power cylinders between the power piston and the end of the cylinder through which the piston rod passes, said pipe means forming part of a closed loop circuit which is connected to a source of pressurized fluid, and control means governing the flow of the pressurized fluid in said closed loop circuit such that the power pistons and displacement members are retracted faster than they move forward and such that before any one displacement member finishes its forward movement the other or another displacement member commences its forward movement whereby a smooth delivery of pumped material is obtained, wherein said control means comprises sensing valve means associated with each power cylinder and arranged to be actauted at at least two positions of the power piston within the power cylinder, the sensing valve means for each power cylinder comprising a first valve which is actuated when the power piston reaches substantially the end of its retraction stroke and a second valve which is actuated when the power piston is at a position a distance on the order of 10% of the length of the stroke of the power piston before the end of its forward stroke, and check valve means connected to vent and close the closed loop circuit and responsive to the actuation of said sensing valve means.

13. A pump system as claimed in claim 12, in which said sensing valve means comprise mechanically operated pilot valves.

14. A pump system in accordance with claim 12 in which each of said sensing valves is connected directly to said source of pressurized fluid and, when opened, allows the fluid pressure generator by said source to pass to an associated valve of said check valve means to open said associated valve and vent the closed loop circuit.

15. A pump system as claimed in claim 12, which includes a power-driven pump to supply fluid under pressure for displacement of said power pistons, a directional valve connected between said power-driven pump and the power cylinders, and means connecting the output side of said sensing valve means to said directional valve whereby pressure from said power-driven pump is switched progressively from one power cylinder to another in dependence on movement of the power pistons in the power cylinders.

16. A pump system as claimed in claim 15, which includes a further pilot-operated directional valve between the output side of the sensing valve means of each power-cylinder and said directional valve connected to the power-driven pump, each said directional valve being associated with adjustable flow restrictors.

17. A pump system as claimed in claim 12, which includes adjustable flow restrictors associated with said check valve means to control the speed of reaction thereof.

18. A pump system as claimed in claim 12, in which the retraction movement of the power piston in each power cylinder is stopped by a hydraulic cushion.

19. A pump system comprising at least two pumping cylinders in each of which a displacement member is reciprocably movable, an equal number of power cylinders in each of which a power piston is reciprocably movable, piston rods connecting the respective power pistons and displacement members, first valve means associated with said pumping cylinders and arranged so that as each displacement member moves in one direction material to be pumped is drawn into the associated pumping cylinder from a source and as each displacement member moves in the other direction it forces the indrawn material into delivery means, pipe means connecting the annular chambers of each of the power cylinders between the power piston and the end of the cylinder through which the piston rod passes, said pipe means forming part of a closed loop circuit which is connected to a source of pressurized fluid, and control means governing the flow of the pressurized fluid in said closed loop circuit such that the power pistons and displacement members are retracted faster than they move forward and such that before any one displacement member finishes its forward movement the other or another displacement member commences its forward movement whereby a smooth delivery of pumped material is obtained, wherein said control means comprises sensing valve means associated with each power cylinder and arranged to be actuated at at least two positions of the power piston within the power cylinder, the sensing valve means for each power cylinder comprising a first valve which is actuated when the power piston reaches substantially the end of its retraction stroke and a second valve which is actuated when the power piston is at a position a distance on the order of 10% of the length of the stroke of the power piston before the end of its forward stroke, said first and second valves being mechanically operated pilot valves, check valve means connected to vent and close the closed loop circuit and responsive to the actuation of said sensing valve means, adjustable flow restrictors associated with said check valve means to control the speed of reaction thereof, each of said sensing valve means being connected directly to said source of pressurized fluid such that actuation in the sense to open the valve allows the fluid pressure generated by said source to pass to said check valve means to open said check valve means and vent the closed loop circuit, a power-driven pump to supply fluid under pressure for displacement of said power pistons, a directional valve connected between said power-driven pump and the power cylinders, adjustable flow restrictors provided in associated with each directional valve, means connecting the output side of said sensing valve means to said directional valve whereby pressure from said power-driven pump is switched progressively from one power cylinder to another in dependence on movement of the power pistons in the power cylinders, and a pilot-operated directional valve between the output side of the sensing valve means of each power-cylinder and said directional valve connected to the power-driven pump, the retraction movement of the power piston in each power cylinder being stopped by a hydraulic cushion.

* * * * *

UNITED STATES PATENT AND TRADEMARK OFFICE

CERTIFICATE OF CORRECTION

PATENT NO. : 4,490,096

DATED : December 25, 1984

INVENTOR(S) : Frederick J. Box

It is certified that error appears in the above—identified patent and that said Letters Patent is hereby corrected as shown below:

On the title page;

In the International Reference No. [30] on the front page of the patent, Foreign Application Priority Data, the date of United Kingdom Patent No. 8135494 should read -- Nov. 25, 1981 -- and not "Nov. 25, 1982".

In the International Reference No. [73] on the front page of the patent, the assignee should read -- Frederick James Box and Hands-England Drilling Limited -- and not "Hands-England Drilling Limited".

Signed and Sealed this

*Twenty-seventh* Day of *August 1985*

[SEAL]

*Attest:*

DONALD J. QUIGG

*Attesting Officer* *Acting Commissioner of Patents and Trademarks*